United States Patent [19]

Hall

[11] 4,266,525

[45] May 12, 1981

[54] PREFABRICATED FIREPLACE FOUNDATION

[75] Inventor: John R. Hall, 6962 Paddison Rd., Cincinnati, Ohio 45230

[73] Assignees: J. R. Hall; R. J. Hall, both of New Richmond, Ohio

[21] Appl. No.: 42,323

[22] Filed: May 25, 1979

[51] Int. Cl.[3] ..... F24B 7/00

[52] U.S. Cl. ..... 126/121; 126/242; 126/143

[58] Field of Search ..... 126/120, 121, 242, 143; 237/51

[56] References Cited

U.S. PATENT DOCUMENTS

| | | | |
|---|---|---|---|
| 260,199 | 6/1882 | Howard | 126/143 |
| 1,681,606 | 8/1928 | Blanchard | 126/121 |
| 1,681,995 | 8/1928 | Miles | 126/121 |
| 2,832,332 | 4/1958 | Johnson | 126/121 |
| 3,096,754 | 7/1963 | Hawrey | 126/121 |
| 4,062,344 | 12/1977 | Mayer | 126/120 |
| 4,085,727 | 4/1978 | Gillpatrick | 126/143 |
| 4,095,581 | 6/1978 | Billmeyer | 126/143 |
| 4,184,474 | 1/1980 | Pulliam | 237/51 |

FOREIGN PATENT DOCUMENTS

| | | | |
|---|---|---|---|
| 779198 | 7/1957 | United Kingdom | 126/143 |
| 838251 | 6/1960 | United Kingdom | 126/143 |

*Primary Examiner*—Herbert F. Ross
*Attorney, Agent, or Firm*—Wood, Herron & Evans

[57] ABSTRACT

A prefabricated fireplace foundation in which the fireplace's floor is installed directly on top of a structurally rigid foundation box. The foundation box incorporates an intake air chamber which opens into the fireplace through use of an exhaust air stack that projects through the fireplace's floor from the box's top wall, and that opens into the outside atmosphere at an intake port in the box's sidewall. A valve is provided to open and close the intake port as desired by the user, the valve being operable through use of a handle accessible at the front of the fireplace. The foundation box also incorporates an ashes chamber which opens into the fireplace through use of an ashes trap that projects through the fireplace's floor from the box's top wall. The ashes trap allows fireplace ashes to be discharged into the box's ashes chamber, an ash door being provided by which the ashes can be withdrawn when cleanout is required. The exhaust air stack and ashes trap are readily removable and attachable with the foundation box to allow shipment of the foundation in a knock-down attitude, and to allow erection of the foundation in final configuration prior to installation, without use of hand tools.

8 Claims, 6 Drawing Figures

PREFABRICATED FIREPLACE FOUNDATION

This invention relates to fireplaces. More particularly, this invention relates to a prefabricated foundation for a fireplace.

Fireplaces are, of course, very well known to the prior art. In this day, however, historical type fireplaces present a potential energy problem to the residential home. The historical interior fireplace is that type where combustion air for the fire in the fireplace is provided by the interior air of the home. And since a fire is used only in cold weather, the home's interior air has been heated by the home's furnace before being drawn into the fireplace as combustion air. With increasing energy prices, it is becoming ever more costly to warm or heat the air in a home so that it is not desirable to waste the home's warm furnace heated air as combustion air for a fireplace fire. On the other hand, a fireplace is generally thought to be a worthwhile feature in a home because of the aesthetically desirable characteristics of a log fire in a living room or game room or den during cold, winter, weather.

It is known in the fireplace art to duct atmosphere air from outside a home into a homes's fireplace through suitable intake and exhaust ports. This, of course, permits outside air to be used as combustion air for the fireplace's fire. In turn, this helps to maintain the home's furnace heated air within the home as it is not needed to function as combustion air for fires in the fireplace. However, such ductwork systems as are known to the prior art for accomplishing this objective, as far as I am aware, must be installed on location by skilled workmen and are tailored for the particular fireplace being erected. In other words, the ductwork employed is expensive to the homeowner to install, and therefore may not be attractive to the homeowner in the first instance because of the expense in connection with it.

It has been the primary objective of this invention, therefore, to provide a prefabricated fireplace foundation on which an interior fireplace may be built, the fireplace floor being supported directly on a structurally rigid foundation box. The foundation box incorporates an intake air chamber which opens into the fireplace through use of an exhaust air stack that projects through the fireplace's floor from the box's top wall, and that opens into the outside atmosphere at an intake port in the box's sidewall. A valve is provided to open and close the intake port as desired by the user, the valve being operable through use of a handle accessible at the front of the fireplace. The foundation box, preferably, also incorporates an ashes chamber which opens into the fireplace through use of an ashes trap that projects through the fireplace's floor from the box's top wall. The ashes trap allows fireplace ashes to be discharged into the box's ashes chamber, an ash door being provided by which the ashes can be withdrawn when cleanout is required. The exhaust air stack and ashes trap, in preferred form, are readily removable and attachable with the foundation box to allow shipment of the foundation in a knock-down attitude, and to allow erection of the foundation in final configuration prior to installation, without use of hand tools. In the case of a residential home fireplace where the fireplace's hearth is elevated to above room floor level, the foundation box may be located on the room floor to establish the elevated hearth location. This prefabricated foundation, since it provides combustion air to the fireplace chamber from exterior of the home, allows the fireplace chamber itself to be fully sealed off, e.g., by glass doors, from the room in which the fireplace is located, thereby preventing use of furnace heated air as combustion air for the fire while permitting the desirable aesthetic values of the fire to be experienced by the room's occupants.

Other objectives and advantages of this invention will be more apparent from the following detailed description taken in conjunction with the drawings in which:

FIG. 3 is a perspective view of the prefabricated fireplace foundation, prior to installation, in accord with the principles of this invention;

Figure 5:
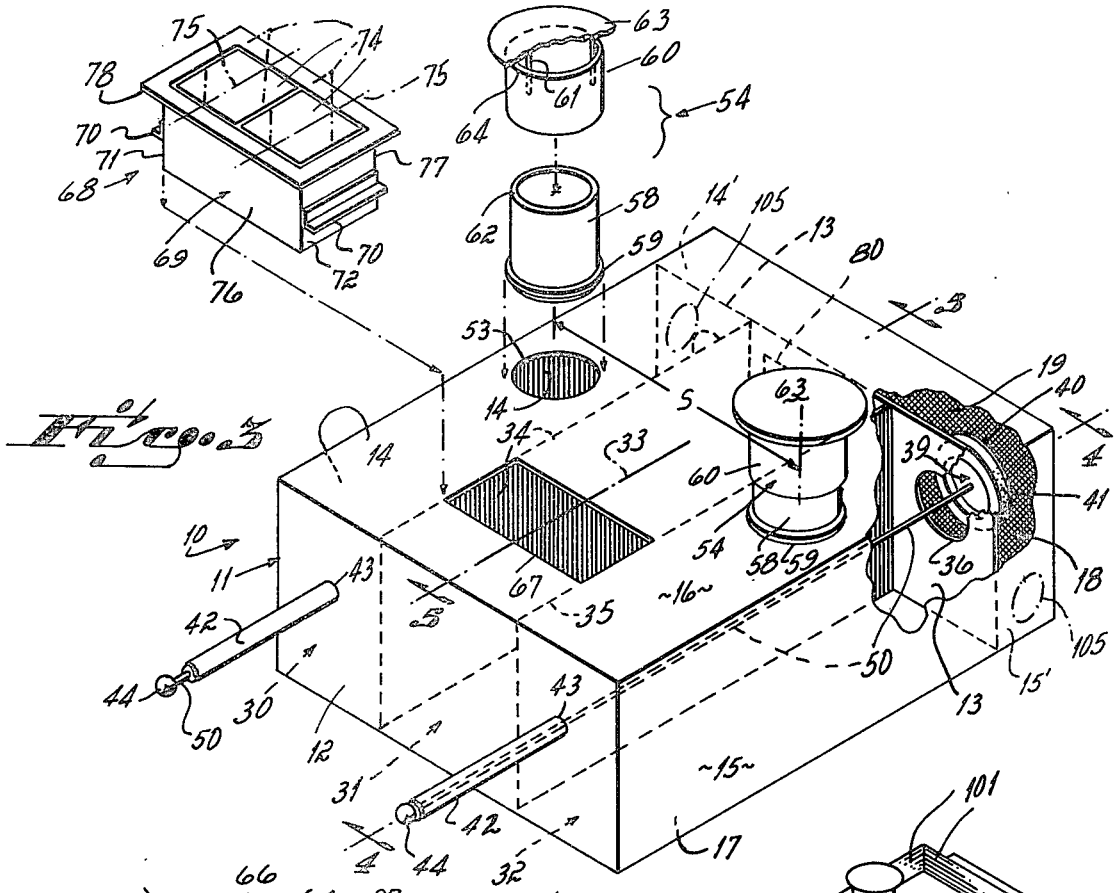
FIG. 5 is a cross-sectional view taken along line 5—5 of FIG. 3.
Figure 4:
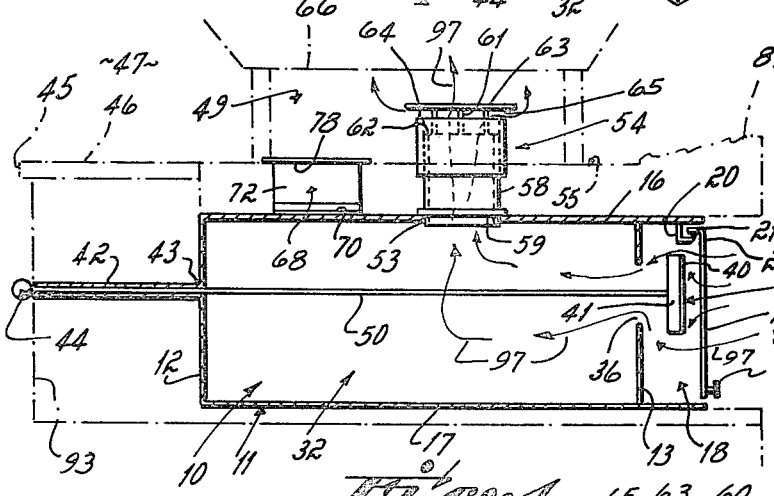
FIG. 4 is a cross-sectional view taken along line 4—4 of FIG. 3.

The prefabricated fireplace foundation 10 itself is illustrated in perspective in FIG. 3, and the foundation assembled in combination with a fireplace 9 is illustrated in FIG. 1, 2, 4 and 5. The prefabricated fireplace foundation 10 is comprised basically of a structurally rigid foundation box 11 fabricated of, for example, sheet metal, and having a generally rectangular cross-sectional configuration. The foundation box 11 includes side walls which include front wall 12, rear wall 13, opposed sidewalls 14, 15, top wall or ceiling wall 16 and bottom wall or floor 17, the top 16 and bottom 17 walls being parallel one to the other. As illustrated in FIGS. 3–5, the sidewalls 14, 15, and top 16 and bottom 17 walls extend beyond the rear wall 13 to define an inlet air compartment 18 that is closed at its outside face by a screen 19. The screen 19 is hingedly connected to the foundation box's top wall 16 by cooperating hooks 20, 21, one set 20 fixed to the underside of the box's top wall and the other set 21 fixed to top edge 22 of the screen 19. This allows the screen 19 to be lifted open (as shown by phantom arrow 23) through use of handle 24 for purposes described in greater detail below.

The interior of the prefabricated foundation box 11 is comprised of three parallel longitudinal chambers 30–32 relative to the longitudinal axis 33 of the foundation box. These three compartments 30–32 are air tight relative one to another, the three compartments being defined by interior walls 34, 35 spaced from one another and generally parallel to the longitudinal axis 33 of the foundation box 11. The two outboard intake air chambers 30, 32 each include an intake port 36 in rear wall 13. The intake port 36, when the foundation box 11 is installed beneath a fireplace as illustrated in FIGS. 1, 2, 4 and 5, is exposed to outside or atmosphere air 38 through screen 19. Each intake air chamber 30, 32 is openable and closeable through use of a valve 39 that cooperates with intake port 36. Each valve 39 is comprised of a plate 40 and rubber gasket seal 41, and includes a stem 50 which extends the length of the chamber 30 or 32 and a distance D substantially beyond the front wall 12 thereof. Each stem 50 is carried in a guide tube 42 rigidly fixed at one end 43 to the chamber's front wall 12. A knob 44 is threaded on the exposed or free end of the stem 50. When the foundation box 11 is installed as shown in FIGS. 2 and 4, and because the length D that the stem 50 extends beyond the box's front wall 12 also allows it to extend beyond front edge 45 of the fireplace's hearth 46, the valves's knob or handle 44 is manually accessible to the fireplace user from interiorly of the room 47 that the fireplace 9 serves. This valve 39 structure, which is manually operable at a position beneath the fireplace's upraised hearth 46 (relative to the room's floor 48) inside the room 47 where the fireplace 9 is located, controls the intake of outside air in the fireplace chamber 49 when the fireplace foundation 10 is installed. Note, therefore, that handles 44 are positioned between phantom planes that include the box's ceiling wall 16 and floor wall 17 substantially beyond the front wall 12.

Each intake air chamber 30, 32 also includes an outlet port 53 in top wall 16 that cooperates with exhaust air stack 54 which extends vertically upward from the box's top wall (and from room floor 48) when the foundation 10 is installed. Each exhaust air stack 54 is of a height H so that it projects through fireplace floor 55 and opens into fireplace chamber 49 when the floor 55 is installed on the box's top wall 10, see FIG. 2. Each exhaust air stack 54 includes an inner sleeve or stack section 58 with circumferential collar 59 at the bottom end. The collar 59 allows the inner sleeve 58 to be seated in and connected with outlet port 53 in the foundation box's top wall 16 without use of hand tools upon erection of the foundation 10. This allows the exhaust air stack 54 structure to be removed from the foundation box 11 during shipment of the foundation 10 from manufacturing site to use site. Each stack 54 also includes an outer sleeve or stack section 60 receivable in telescoping relation with the inner stack section 58. The outer stack section 60 includes support ribs 61, fixed to the interior surface of the outer stack at the top edge thereof, which butt against the top edge 62 of the inner stack 58 when the outer stack is seated in telescoped fashion over the inner stack as shown in FIG. 4. The support ribs 61 also mount a cap 63 in spaced relation from the top edge 64 of the outer stack 60. This establishes an annular exhaust port 65 for outside combustion air interiorly of the fireplace's combustion chamber 49 when the foundation 10 is installed, see FIG. 4. The height H of the exhaust stack 54 structure is preferably such that the annular port 65 is spaced a distance D' above the fireplace floor 55 when the prefabricated foundation 10 is installed but beneath grate 66 in the fireplace 9. Note further that the dual exhaust stack 54 structures are spaced one from another a distance S such that same are both located in the fireplace's grate 66, thereby providing combustion air to logs (not shown) or other combustible material carried in that grate.

The middle chamber 31, positioned between the intake air chambers 30, 32, is an ash dump chamber, and includes an ash dump port 67 adapted to receive an ashes trap 68 as shown in FIG. 3. The ashes trap 68 includes a stack section 69 sized to be telescoped into ash dump port 67, and is provided with support flanges 70 exteriorly fixed to side walls 71, 72 which overlie the foundation box's top wall 12 when the stack section 69 is seated in the dump port 67. This structure permits the ashes trap 68 to be removed from the foundation box 11 during shipment of the foundation from manufacturing site to user site, and also allows it to be easily installed with the foundation box at the user site without use of hand tools. The ashes trap 68 also includes lids 74 hingedly connected along hinge lines 75 with the front wall 76 and rear wall 77 of the stack 69. The lids 74 allow the stack 69 to be opened and closed relative to ashes on the fireplace's floor 55 so that those ashes can be removed from the fireplace chamber 49 into the foundation box's ash dump chamber 31 when desired by the fireplace 9 owner.

Note particularly the ashes trap 68 includes an outwardly extending flange 78 around the top edge thereof, and that the height H' of the ashes trap's flange above the foundation box's top wall 12 is substantially equal to thickness T of the fireplace's floor 55 when that floor 55 is installed on top the box 11 as shown in FIG. 2. This permits the ashes trap's flange 78 to overlie the fireplace's floor 55 after installation so that ashes do not pass between the front 76, rear 77 and side 77, 72 walls of the ashes trap 68 and that floor 55, and instead are directed through the trap 68 into the foundation box's ashes chamber 31. The ashes chamber 31 of the prefabricated foundation 10 is accessible through rear wall 13 of the foundation box 11 by use of an access port 80 which itself is accessible from outside that home wall 81 on which the fireplace 9 is located. The access port 80 is normally closed by door 82 which is hinged along a vertical hinge axis through use of top 83 and bottom 84 hinges, and is accessible to the user after screen 19 is lifted, see FIGS. 4 and 5.

Figure 1:
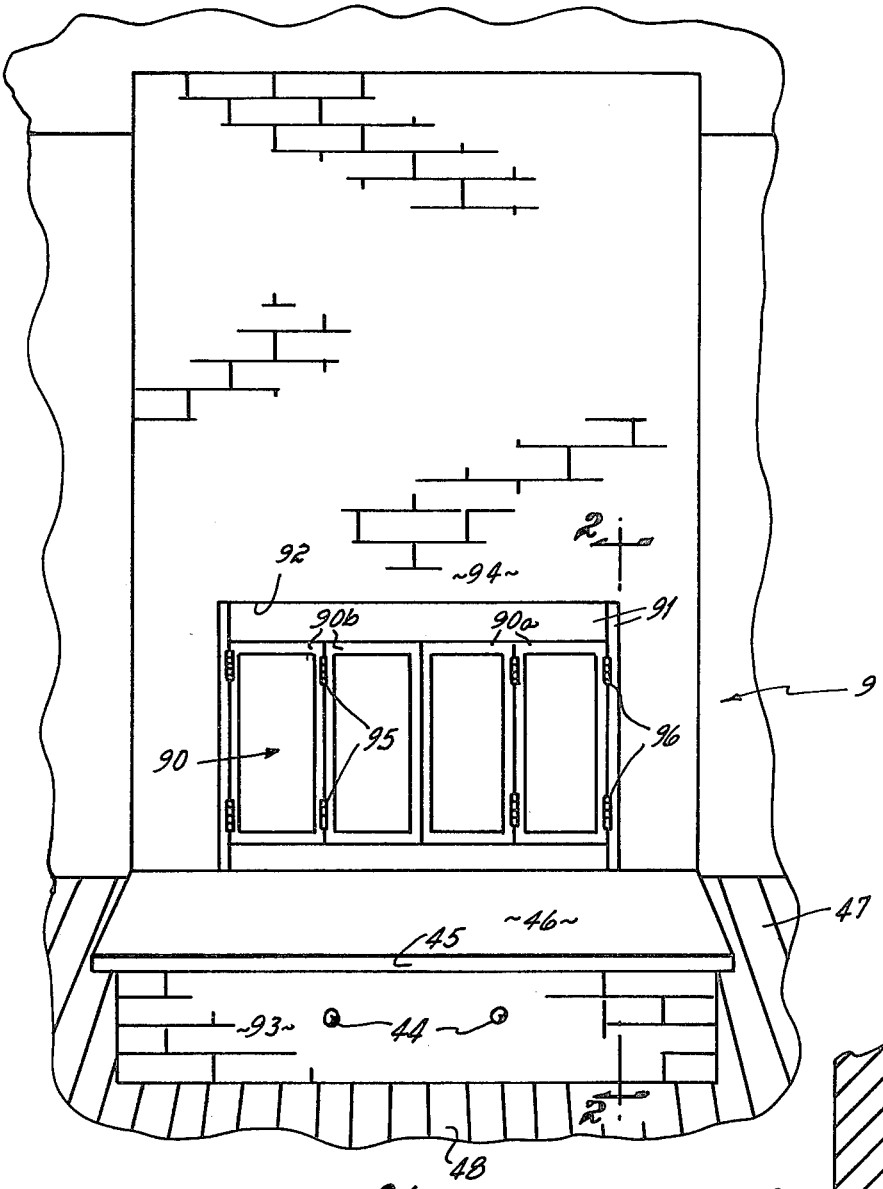
FIG. 1 is a front perspective view of a fireplace erected on a prefabricated fireplace foundation in accord with the principles of this invention.
Figure 2:
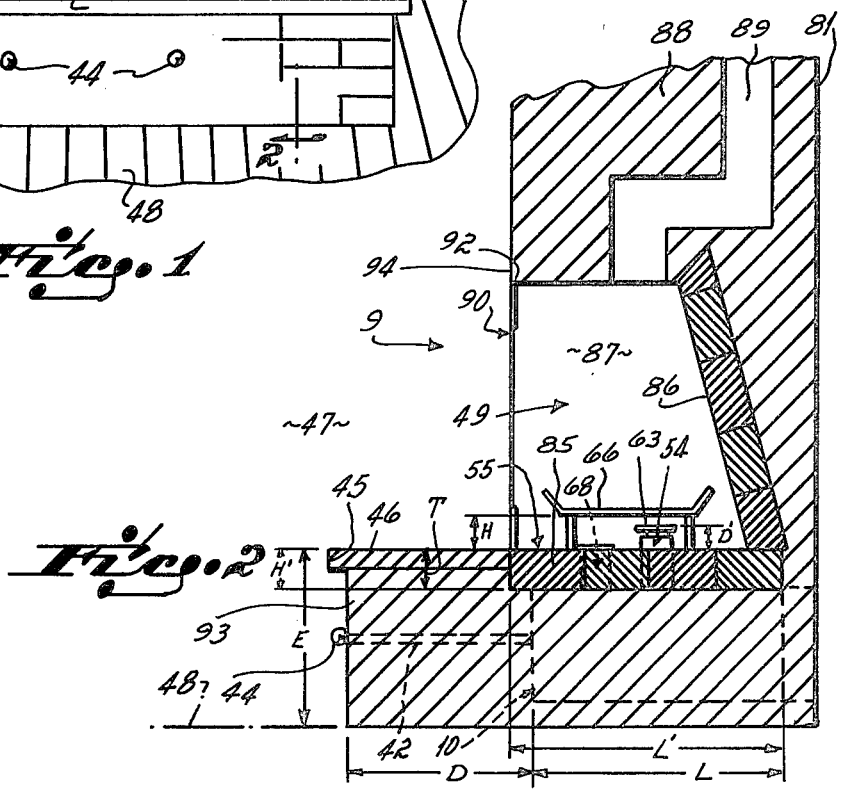
FIG. 2 is a cross-sectional view taken along line 2—2 of FIG. 1.

Use of the prefabricated fireplace foundation 10 illustrated in FIGS. 3–5 is particularly shown in FIGS. 1, 2 and 4. In installation, and after the exhaust air stacks 54 and ashes trap 68 are seated in their respective ports 53, 67 in the foundation box 11, the foundation box is located on a room's floor 48 and indented or retracted adjacent to an outside wall 81 where fireplace 9 is to be installed. The fireplace's floor 55 is then laid down on the top wall 16 of the foundation box 11 and, as shown in FIG. 2, is comprised of individual firebrick 85. The same firebrick 85 is used for the fireplace's backwall 86 and sidewalls 87. Note that the thickness T of the firebrick 85 is less than the height H of the exhaust air stacks 54 so that the annular exhaust air ports 65 are located above the fireplace's floor 55 yet beneath the grate 66. Note also that the height H' of the ash trap's flange 78 above the foundation box's top wall 16 is substantially equal to thickness T of the firebrick 85 to accommodate the brick 85 floor. Of course, the fireplace 9 also is provided with a chimney 88 which defines a flue 89 that extends upwardly from the fireplace chamber 49.

In this installation shown in FIGS. 1, 2 and 4, the fireplace's floor 55 is substantially elevated a distance E above room floor 48 level since the foundation box 11 itself is positioned on and supported by that floor. A box like framework 93 is located on the room floor 48 so it extends into the room 47 from the fireplace's front face 94, and a hearth 46, e.g., of flagstone or brick, is laid over that framework. This provides a raised hearth 46 for the fireplace that extends outwardly into the room 47 from the fireplace's floor 55 as is considered aesthetically desirable. Because the length of the foundation's valve stems 50 are such that the valves's knobs 44 extend beyond that hearth framework 93 into the room 47, the outside air control valves 39 are accessible for use within the room's interior from a position between the fireplace's hearth and the room's floor. But the foundation box 11 itself is of a length L not substantially greater than the depth L' of the fireplace chamber's floor 55.

The fireplace chamber 49, when the prefabricated foundation 10 of this invention is used, may be sealed off from the room's interior 47 through use of glass doors 90 and door frame 91. The door frame 91 is, of course, sealingly connected to opening 92 in the chimney's face 94. The glass doors 90, which are fabricated of tempered glass, are hingedly connected in pairs by hinges 95. The right hand pair 90*a* and left hand pair 90*b* of doors 90 are hingedly connected to the door frame 91 by hinges 95. The doors 90 cooperate with the door frame 91 to open the fireplace chamber 49 to the room's interior 47 when it is necessary to provide more logs on the grate 66, and are closable to seal off the fireplace chamber from the room's interior after a fire has been lighted.

Once the prefabricated foundation 10 has been installed as shown in FIGS. 1, 2 and 4, and in use, outside air 38 admitted to the sealed off fireplace chamber 49 is controlled through use of valves 39 and manually operable knobs 44 inside the room 47. The outside air follows combustion air lines 97 illustrated in FIG. 4 through the inlet ports 36, intake air chambers 30, 32 and exhaust air stacks 54, and because the glass doors are sealed this combustion air 95–97 constitutes the entire supply of combustion air for logs (not shown) burning in the fireplace chamber 49. The screen 19 prevents animals or the like from entering the intake air chambers 30, 32 through the intake ports 36 when closed as shown in FIG. 4. When it is desired to clean the fireplace chamber 49, the lids 74 on the ash trap 68 need merely be oriented in vertical fashion (as shown by the phantom line position in FIG. 3), and the ashes swept through the ash trap into the ash chamber 31 defined in the foundation box 11. The ash chamber 31 is emptied from outside the building 81 by first lifting the screen 19, and thereafter opening the ash door 82 to clean out that ash chamber. It is, of course, possible to provide an ash dump drawer (not shown) in the ash chamber 31 as an alternative, the drawer being removable through the foundation box's front wall 12 or rear wall 13 which has been structured to accommodate that removal. A further alternative is to install an ash door (not shown) in the floor 17 of the foundation box 11 so that, if the foundation box's floor is accessible from a room beneath the room 47 in which the fireplace 9 is located, the ash chamber 31 could be cleaned by opening that floor door (not shown).

Figure 6:
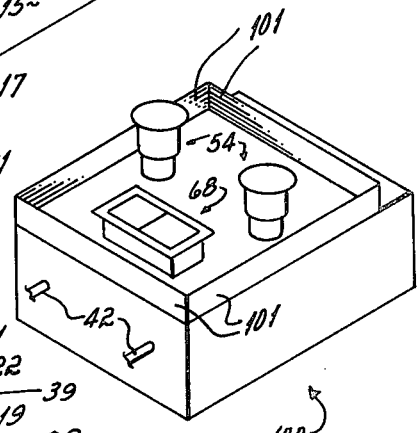
FIG. 6 is a perspective view similar to FIG. 3 but showing an alternative embodiment of the prefabricated fireplace foundation.
Figure 5:
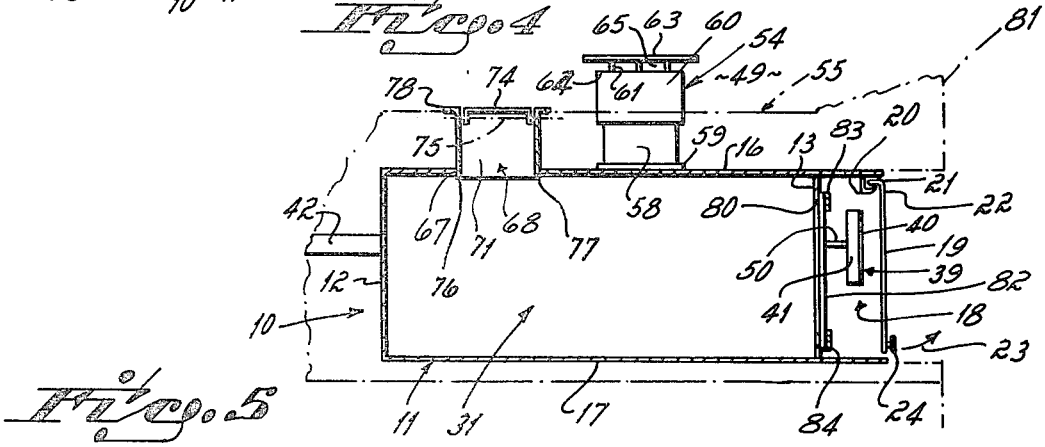

An alternative embodiment of the prefabricated fireplace foundation is illustrated in FIG. 6. The structure of the FIG. 6 foundation 100 is identical to that shown in the FIGS. 1 and 5 embodiment with the exception that an upstanding border flange 101 is provided coextensive with the side 14, 15, front 12 and rear 13 walls of the foundation box 11. This border flange 101, which is of a height substantially equal to the height H' of the ash trap's flange 78 above the foundation box's top wall 16, permits a fireplace floor 55 of sufficiently fire resistant and insulative ceramic material to be poured or cast onto the top of the foundation 100 when it is installed and a fireplace erected thereon. This upstanding flange 101, therefore, permits the fireplace floor 55 to be cast in place, as opposed to being fabricated of individual firebricks 85, on the foundation box 11 at the time of installation. As with the FIGS. 1–5 embodiment, the annular exhaust ports 61 of the exhaust air stacks 54 are at a height H above the foundation box's top wall 16 which is substantially greater than the height H' of the ash trap's flange 78 above that top wall, thereby insuring combustion air distribution within the fireplace chamber 49.

Another alternative feature that may be incorporated in the prefabricated fireplace foundation 10 without departing from the scope of the invention includes knockout plates 105 in sidewalls 14', 15' of the inlet air compartment 18. In the event the foundation's inlet air compartment 18 does not back up against an outside wall 81 of the room 47 where it is installed, i.e., if the inlet air compartment 18 backs up against an inside wall such as a wall between a garage and a family room when the fireplace foundation 10 is installed in a residential home, then a plate (not shown) can be attached to the ports formed by removal of the knockout plates 105. This ductwork (not shown) is then directed to outside air and not to, e.g., garage air.

A further alternative feature is the automatic control of valves 39 through use of a thermostat system (not shown) instead of manual control through use of knobs 44 inside the room 47. In this connection, a servo-motor (not shown) which is on-off controlled by a thermostat (not shown) positioned inside the fireplace chamber 49 would reciprocate stems 50 to open and close intake ports 36. It is contemplated the thermostat (not shown) would be set to open intake ports 36 as soon as a fire is started in the fireplace chamber 49 and to close those intake ports 36 when no fire is present in the fireplace chamber 49.

Having described in detail the preferred embodiment of my invention, what I desire to claim and protect by Letters Patent is:

1. A prefabricated fireplace foundation for installation in a room, said foundation comprising a foundation box of structurally rigid construction, said foundation box comprising a ceiling wall, side walls, and a floor wall, said ceiling wall being adapted to receive and support a fireplace floor thereon, and said foundation box's side walls being sized so that said ceiling wall is positionable above said room's floor when said foundation is installed, at least one intake air chamber defined by said foundation box, said chamber being at least partially defined by said ceiling wall and said floor wall, said intake air chamber including an inlet port for introducing outside air into said intake air chamber and an outlet port for exhausting that atmospheric air from said intake air chamber, an exhaust air stack connected with said outlet port, said exhaust air stack extending upwardly from said ceiling wall to locate an exhaust air port above said fireplace floor when said floor is constructed on said foundation box, a valve connected with said inlet port for opening and closing said intake air chamber to outside air, and a manually operable handle connected with said valve, said handle being positioned between phantom planes that include said box's ceiling wall and floor wall respectively, and said handle being positioned substantially beyond the front one of said side walls in both valve open and valve closed positions, the distance of said handle from said front one of said side walls being such as to position said handle adjacent to and beneath the front edge of a fireplace hearth when said foundation is installed, a fireplace floor positioned thereon, and a hearth extended outwardly from said fireplace floor, thereby permitting access to said handle by a user adjacent the front edge of said hearth between said hearth and said room's floor.

2. A prefabricated fireplace foundation as set forth in claim 1, said valve comprising a plate to open and close said inlet port, a stem connected between said plate and said handle, and a guide tube rigidly fixed to the front one of said side walls, said stem being received in sliding relation within said guide tube.

3. A prefabricated fireplace foundation as set forth in claim 1, said foundation comprising an ash chamber defined by said foundation box, said ash chamber being adapted to receive and store ashes from the fireplace, and an ashes trap connected with an ash port in said ash chamber, said ashes trap being of a height substantially the same as the height of the fireplace floor to be constructed on said foundation box's top wall.

4. A prefabricated fireplace foundation as set forth in claim 3, said ashes trap comprising sidewall structure adapted to be received in telescoping relation with said ash port, and support structure connected to said ashes trap for supporting said ashes trap in assembled relation with said foundation box, said ashes trap being removable from said foundation box during shipment of said foundation to a use site.

5. A prefabricated fireplace foundation as set forth in claim 1, said exhaust air stack comprising a sleeve adapted to be received in telescoping relation with said outlet port, said sleeve being removable from said foundation box during shipment of said foundation to a use site, support structure connected to said sleeve for supporting said sleeve in assembled relation with said foundation box, and a cap connected to the top end of said sleeve for preventing ashes from falling from a grate on the fireplace floor into said intake air chamber.

6. A prefabricated fireplace foundation as set forth in claim 5, said sleeve structure comprising a lower stack having an exterior extending flange adjacent one edge thereof and an upper stack received in telescoping relation with said lower stack, said upper and lower stack structure being removable from said foundation box during shipment of said foundation to a use site.

7. A prefabricated fireplace foundation as set forth in claim 1, said foundation comprising a screen connected in a swinging relation with said foundation box, said screen preventing entry of animals and the like into said intake air chamber when said valve is open to atmosphere but allowing entry into said ash chamber for removing ashes therefrom.

8. A prefabricated fireplace foundation as set forth in claim 1, said foundation comprising an upstanding flange on the top wall of said foundation box, said flange defining an enclosed area on the top wall of said box within which a fireplace floor may be received and supported.

* * * * *